US006044562A

United States Patent [19]

Dillenbeck

[11] Patent Number: 6,044,562

[45] Date of Patent: Apr. 4, 2000

[54] SAFETY INTERLOCKING BLADE RELEASE MECHANISM FOR HAND HELD CUTTING TOOLS

[76] Inventor: Edward J. Dillenbeck, 20623 Woodstock Ave., Fairview Pk., Ohio 44126

[21] Appl. No.: 09/122,816

[22] Filed: Jul. 27, 1998

[51] Int. Cl.[7] ..... B26B 1/08

[52] U.S. Cl. ..... 30/162; 30/2

[58] Field of Search ..... 30/162, 335, 336, 30/2

[56] References Cited

U.S. PATENT DOCUMENTS

| | | | |
|---|---|---|---|
| 2,874,462 | 2/1959 | Benedict | 30/162 |
| 2,885,779 | 5/1959 | Newkirk | 30/162 |
| 3,176,395 | 4/1965 | Warner et al. | 30/162 X |
| 3,577,637 | 5/1971 | Braginetz | 30/162 |
| 4,242,795 | 1/1981 | Rollband et al. | 30/162 |
| 4,265,017 | 5/1981 | Collins | 30/162 |
| 4,867,985 | 9/1989 | Rehm | 30/162 |
| 4,897,920 | 2/1990 | Dunbar | 30/162 X |
| 5,617,635 | 4/1997 | Berns | 30/162 |

FOREIGN PATENT DOCUMENTS

| | | | |
|---|---|---|---|
| 4315495 | 11/1994 | Germany | 30/162 |

*Primary Examiner*—Douglas D. Watts

[57] ABSTRACT

An improved safety knife which has a hollow body and a blade which is normally retracted within the knife, but can be extended by urging the operating lever (26) down and forward. The lever is connected to the blade carriage near the aft end of a leaf bias beam (24). A sear, protruding inward, at the far aft end of said leaf bias beam serves to interlock the blade and carriage in the cutting position. Upon sensing pressure of the cut, blade carriage pivots at the pivot point (22), causing the sear (28) to disengage from interlock.

At this point, blade and carriage are free to retract into sheathed position within the body. This retraction takes place at the termination of cut, when cutting drag is diminished and knife accelerates towards user.

1 Claim, 2 Drawing Sheets

34
10
12
14
16
18
20
22

36

28
26
28
24
32
30
31
25

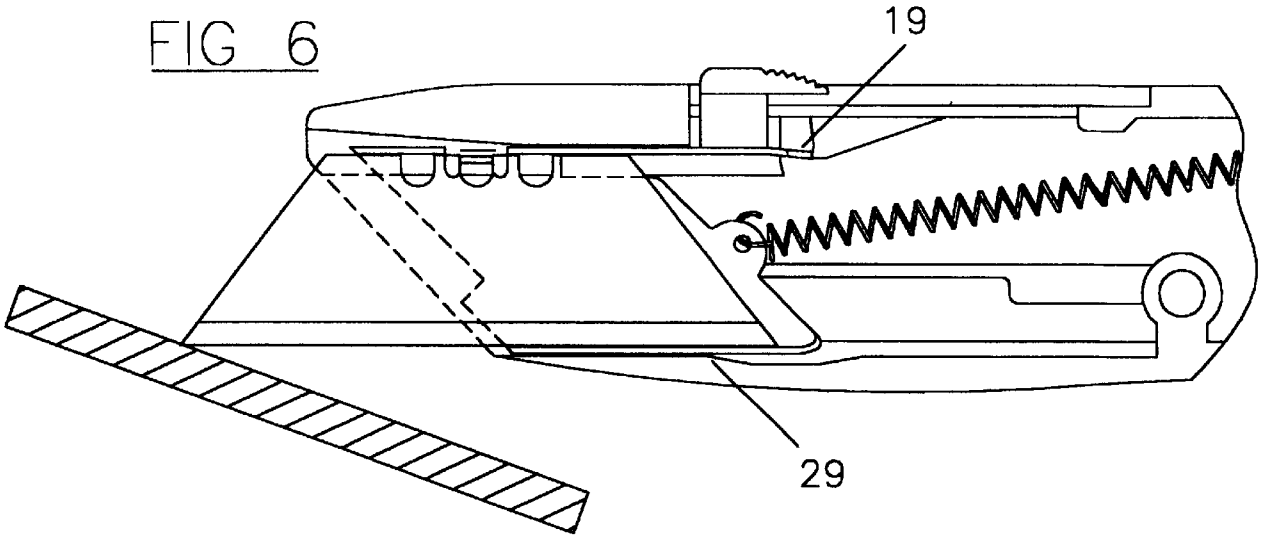
FIG 6
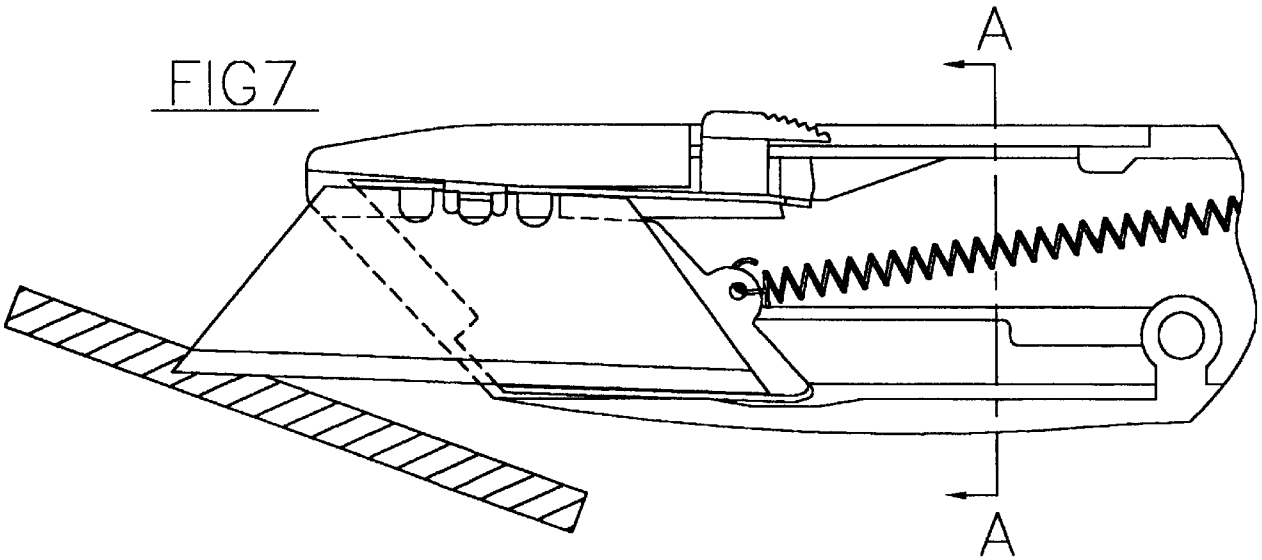
FIG7
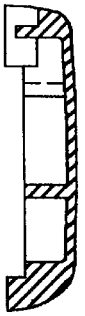
FIG 8
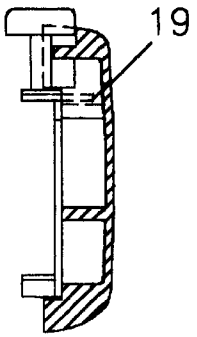
A A

SAFETY INTERLOCKING BLADE RELEASE MECHANISM FOR HAND HELD CUTTING TOOLS

BACKGROUND—FIELD OF INVENTION

This invention relates to hand-held cutting tools, incorporating bias assisted retraction of cutting edge upon release of pressure sensitive interlocking mechanism

BACKGROUND—DESCRIPTION OF PRIOR ART

All prior art knives suffer from one or more of the following serious safety concerns:

(a) In most knives a replaceable blade is immovably fixed at one end of the handle. The blade is constantly exposed with the risk of injury to people or objects nearby while the knife is not engaged in the cut.

To avoid this danger, prior inventors, have proposed arrangements in which the blade is retracted into a shielded position, for example in the body. While this improvement makes for a safer knife, it does not address the greatest danger to users and nearby objects.

(b) This danger exists at the end of a cut, when knife and blade are freed of the cutting drag and accelerate quickly towards the user.

Other inventors have proposed a spring loaded, retractable blade knife. Although this is a much safer configuration that addresses the danger of a rapidly accelerating cutting edge, it still has some major shortcomings:

(c) One being user fatigue and cramping from the sustained force required to keep the blade exposed to address cut. Once cut is engaged, thumb must be removed from the lever to enable spring to retract the blade.

(d) Another shortcoming to this configuration is that the user is required to assume a unnatural and uncomfortable grip. This also leads to fatigue and compromises accuracy of the cut.

OBJECTS AND ADVANTAGES

Accordingly, several objects and advantages of the present invention are.

(a) to provide a autoretractable knife that sets a new standard for safety;

(b) to provide a autoretractable knife that allows for a correct and comfortable ergonomic grip;

(c) to provide a autoretractable knife that is easy for user to operate;

(d) to provide a autoretractable knife that is simple to manufacture;

(e) to provide a autoretractable knife that is inexpensive as it requires only the addition of a bias tension device over prior art, (f) to provide a autoretractable knife that manually retracts easily by a slight downward force on the lever;

Further objects and advantages will become apparent from a consideration of the ensuing description and drawings.

SUMMARY, RAMIFICATIONS AND SCOPE

Accordingly, the reader will see that this blade retracting method can be applied to many cutting instruments used for medical, home and industrial purposes.

The main object of this invention is to lock the blade into cutting position until upward force of the cut releases it and bias tension device urges the blade back into the sheath. Furthermore, the interlocking release mechanism, has the additional advantages in that it frees the thumb and permits the user to assume a natural grip that is both comfortable and safe it provides protection to user, as well as, nearby objects.

it allows the user to retract the blade manually by simply depressing the lever.

it provides added safety, in the toolbox, drawer and tool belt, by retracting the inadvertently exposed blade, upon contacting a object with sufficient force to release sear.

Although the description above contains many specifcities, these should not be construed as limiting the scope of the invention but as merely providing illustrations of the present preferred embodiment of this invention.

DRAWING FIGURES

FIG. 5 replaceable blade

Figures 1, 2, 3, 4, 5:
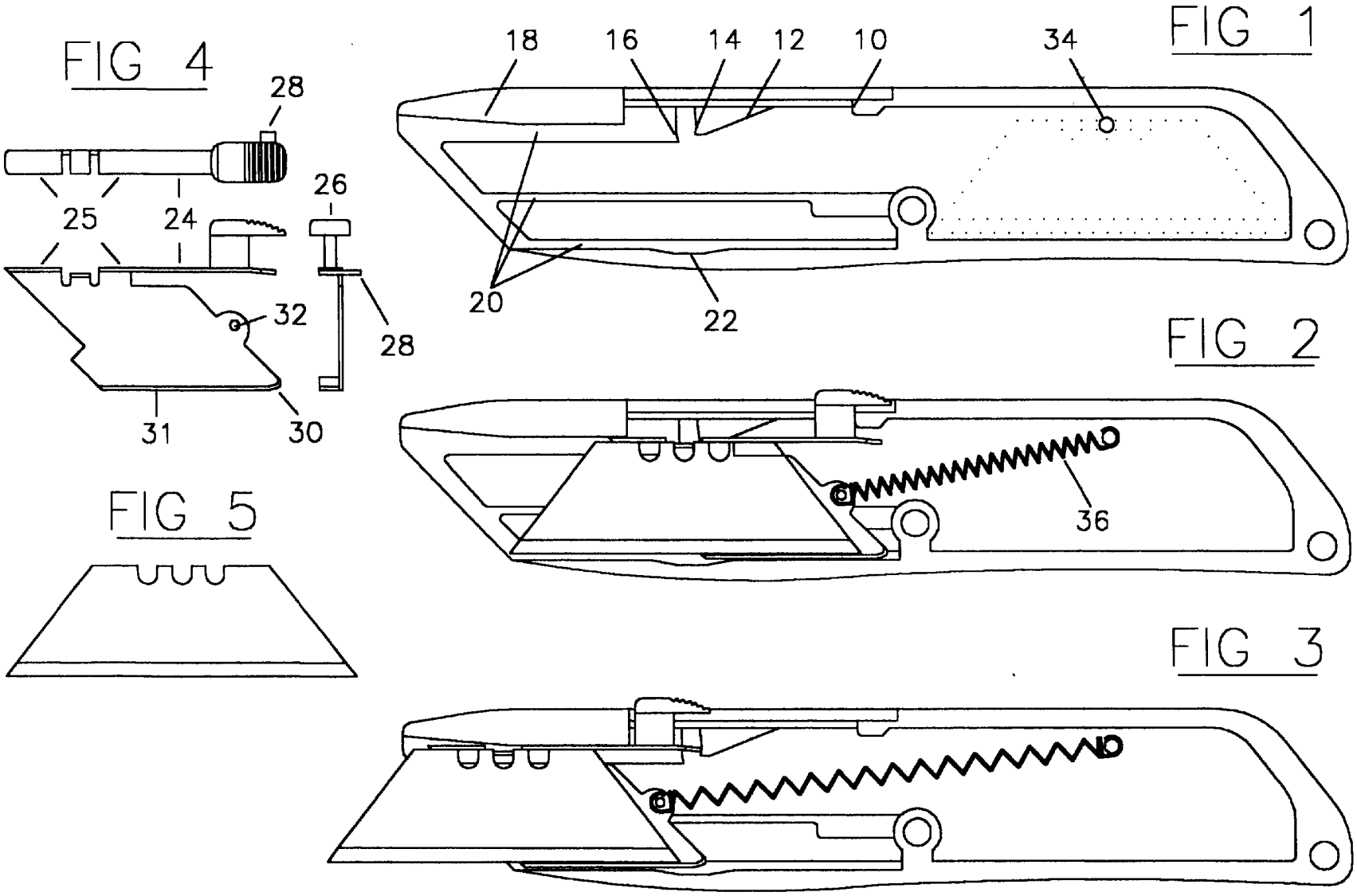
FIG. 1 shows the right half of tie knife body with interlock release features cast into same.
FIG. 2 shows right half of assembly with retracted blade sheathed within the body
FIG. 3 shows same assembly with blade in extended cutting position.
FIG. 4 shows a top, front and end view of blade carriage.

FIG. 6 shows a enlarged view of blade contacting work with interlock engaged.

FIG. 7 shows same view with blade engaged in work and carriage pivoted upwards disengaging interlock.

FIGS. 8 are a cross-sectional views of body and body with carriage.

REFERENCE NUMERALS IN DRAWINGS

10 rear carriage stop 26 lever

12 deflection ramp 28 sear

14 notched interlock 30 radius bend

16 forward carriage stop 31 bottom slide

18 top pivot clearance 32 carriage bias anchor

20 carriage ways 34 body bias anchor

22 bottom pivot clearance 36 bias tension device

24 leaf bias beam 38 pivot

25 top slide

Description—FIGS. 1 to 8

A typical embodiment of the knife body, comprising the static members of the invention, is shown in Fig 1.(front view, right half). All features in FIG. 1 are as cast in body, The knife comprises a hollow handle formed in left and right halves. These halves are held together with a single fastener near the center of the body. Only the right half is shown in the drawings as it embodies all members critical to interlock function.

A operating lever 26, shown in FIG. 4, is connected to a leaf bias beam 24 which is supported at the tail-end of the top carriage slide 25. With blade and carriage in the retracted position FIG. 2, the lever 26 is held firmly against rear carriage stop 10, by bias tension device 36, This bias tension device is coupled to the blade carriage and body at carriage bias anchor 32 and body bias anchor 34.

Blade carriage FIG. 4 is slidably supported in recessed carriage ways 20, FIG. 1 A conventional utility knife blade FIG. 5 is held snugly by blade carriage, so that it can be easily replaced with a sharp blade, when necessary.

As the blade carriage is moved slidably forward in the carriage ways 20, FIG. 1, the sear 28 slides along the deflection ramp 12, until it contacts the forward carriage stop 16, and is guided into notched interlock 14. Interlock engagement of sear 28 is accomplished by upward force of both the bias tension device 36 and leaf bias beam 24. At this moment, the blade is in the extended, working position FIG. 3.

As the blade comes in contact with work FIG. 6, and cut is engaged FIG. 7, upward force causes blade carriage to move in the top pivot clearance 18 and pivot at pivot point 38, thus disengaging the sear 28. Blade and carriage assembly are now free to be retracted instantly into knife body, upon termination of cut, by bias tension device 36. Forward carriage stop 16 is dual purpose in that it also prevents sear 28 from advancing too far forward during a heavy cut and re-engaging in interlock. A small radius bend 30 on the aft end of bottom slide 31, FIG. 4 serves to assist blade carriage out of ramped bottom pivot clearance 22, FIG. 1, Thus blade and carriage continue rearward until lever 26, come to rest at rear carriage stop 10, FIG. 2.

Operation—FIGS. 1,4,6,7

The manner of using the autoretractable, interlocking knife is similar to that of retractable knives in present use. Namely, one first has to depress lever 26 (FIG. 4) and slide it forward until sear 28 is engaged, locking the blade in cutting position.

At this point, the interlocking release mechanism is activated and knife is ready to address the work. FIG. 6. Next, when blade is pulled into the work, the resulting upward force on the blade causes blade and blade carriage to pivot at bottom pivot clearance 22 (FIG. 1). This radial motion is transferred to the aft end of the leaf bias beam 24 FIG. 4, where sear 28 is consequently freed from the notched interlock 14 (FIG. 1), thus freeing blade to quickly snap into sheathed position within the body FIG. 2. This happens as the cutting drag, which has overcome bias tension device 36 (FIG. 2), is diminished at the end of cut.

I claim:

1. A knife comprising: a handle having a hollow interior with top and end openings, a carriage for holding a blade disposed in said hollow interior of said handle, guide rails for guiding said carriage from a blade extended position to a blade retracted position, said carriage having a spring arm with a lever and sear, a second lock part fixed on said handle for engaging said sear and securing said carriage in said knife extending position and, a spring fastened between said carriage and said handle to bias said carriage in the knife retracted position, said guide rails and said opening shaped to allow said carriage to pivot upon engagement of said knife with a work piece such that said sear disengages said second lock part thereby allowing said carriage to be retracted by said spring.

* * * * *